US006452468B1

(12) United States Patent
Jacq et al.

(10) Patent No.: US 6,452,468 B1
(45) Date of Patent: Sep. 17, 2002

(54) SET OF ELECTRICAL UNITS FOR CONTROLLING POWER UNITS

(75) Inventors: Joël Jacq, Osny; Manuel Lima, Sannois, both of (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 10/012,463

(22) Filed: Dec. 12, 2001

(30) Foreign Application Priority Data

Dec. 18, 2000 (FR) ..... 00 16625

(51) Int. Cl.[7] ..... H01H 63/02; H01H 67/02
(52) U.S. Cl. ..... 335/132; 335/6
(58) Field of Search ..... 335/6, 11, 13, 335/132, 202; 361/23–34

(56) References Cited

U.S. PATENT DOCUMENTS 5,541,561 A * 7/1996 Grunert et al. ..... 335/132

FOREIGN PATENT DOCUMENTS

| | | |
|---|---|---|
| EP | 0 774 768 | 5/1997 |
| FR | 2 664 763 | 1/1992 |
| FR | 2 704 352 | 10/1994 |
| FR | 2 758 903 | 7/1998 |
| FR | 2 761 521 | 10/1998 |

* cited by examiner

*Primary Examiner*—Ramon M. Barrera
(74) *Attorney, Agent, or Firm*—Parkhurst & Wendel, LLP

(57) ABSTRACT

The present invention relates to a set of electrical units for controlling power units, comprising a contactor breaker (CD) with a plurality of current-breaking poles actuated by a solenoid (E) and by a control and slipping mechanism (D, S) on the one hand, and by an auxiliary module (MS) plugged on the power outputs of the contactor breaker and connected by control links to the latter on the other hand, characterized by the fact that it includes a control connection block (R) provided with control connectors (G) which connect to control outputs (A1, A2, 21, 22, 14, 13) of the contactor breaker onto which a control terminal (Ba) may be connected alternatively and with control connectors (J) which connect to control outputs (S1, S2, S3, 82, 84, 81) of the auxiliary module (MS) onto which a control terminal (Bs) may be connected alternatively, with electrical links connecting said control connectors (G, J).

8 Claims, 3 Drawing Sheets

SET OF ELECTRICAL UNITS FOR CONTROLLING POWER UNITS

The present invention relates to a set of electrical units for controlling power units comprising a contactor breaker with a plurality of current-breaking poles actuated by a solenoid and by a control and tripping mechanism on the one hand, and an auxiliary module plugged into the power outputs of the contactor breaker and connected through control links to the latter on the other hand. This set is particularly intended for controlling motors.

The implementation of a motor control diagram (direction reverser, wye-delta starter, gear change, . . . ) by associating several electromagnetic units interconnected at power level and at control level according to the desired diagram, is known.

An auxiliary module matched to a contactor is known from FR 2 758 903 or FR 2 761 521, for switching a motor from a direct motion operation over to reverse motion operation. This module is provided with power switching poles actuated by an electromagnetic control driven by a control portion. The control connections between the auxiliary module and the contactor should be implemented as wiring cables.

The object of the invention is to provide a control connection block which may be plugged into the outputs of the contactor breaker and into the outputs of an auxiliary module, providing control links between said units. This connection block provides a wiring memory, prevents wiring errors, is easily mounted and this without having to dismantle the power connections. It may be put in the place of terminal blocks for wiring the control by conventional wiring means and therefore without producing any extra thickness.

The set of units according to the invention is characterized by the fact that it includes a connection block provided with control connectors which connect to control outputs of the contactor breaker, onto which a control terminal block may be connected alternatively, and with control connectors which connect to the control outputs of the auxiliary module, onto which a control terminal block may be connected alternatively, with electrical links connecting said control connectors.

According to one feature, the connection block has connectors and electrical links between said connectors allowing the power outputs of the solenoid coil of the contactor breaker to be connected to outputs which drive, via a logic electronic circuit, a solenoid for controlling power switching poles of the auxiliary module.

According to another feature, the connection block has connectors and electrical links between said connectors allowing the outputs of a first control contact of the contactor breaker to be connected to control outputs of the auxiliary module which are coupled with the logic circuit associated with the solenoid controlling the latter.

According to another feature, the connection block has connectors and electrical links between said connectors allowing the outputs of a second control contact of the contactor breaker to be connected to control outputs of the auxiliary module.

The invention will now be described in more detail with reference to an embodiment given by way of example and illustrated by the appended drawings wherein.

Figure 1:
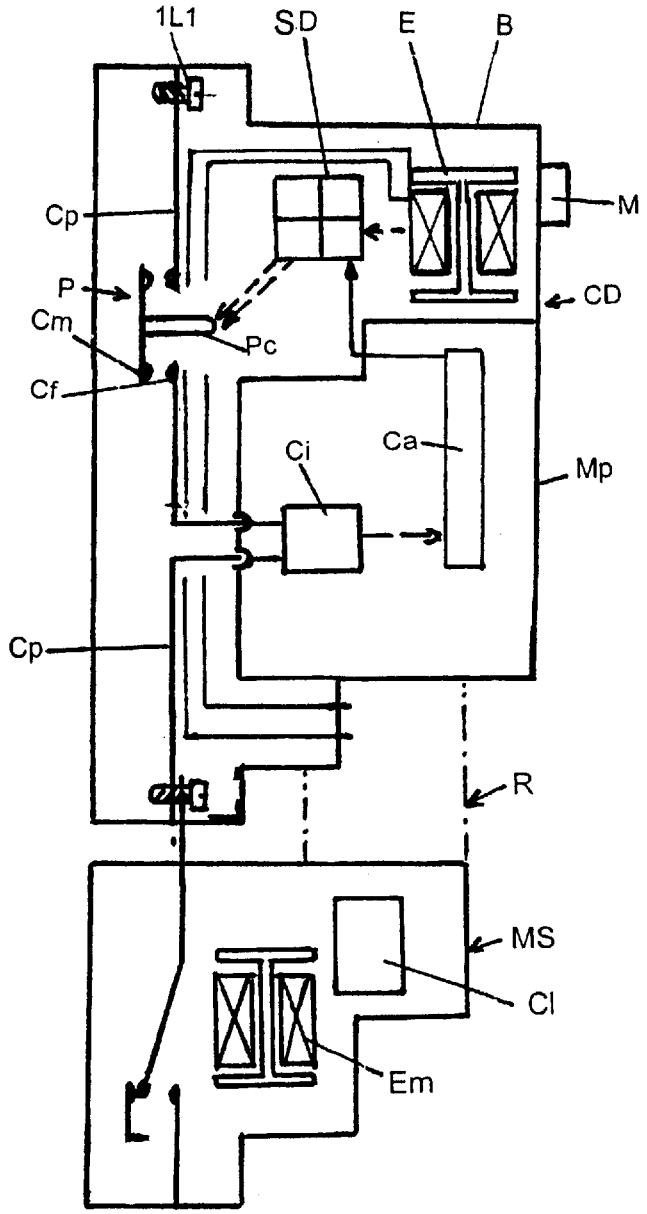
FIG. 1 is a side view diagram of a contactor breaker and of an auxiliary module which is matched to the latter in order to form the set according to the invention.
Figure 2:
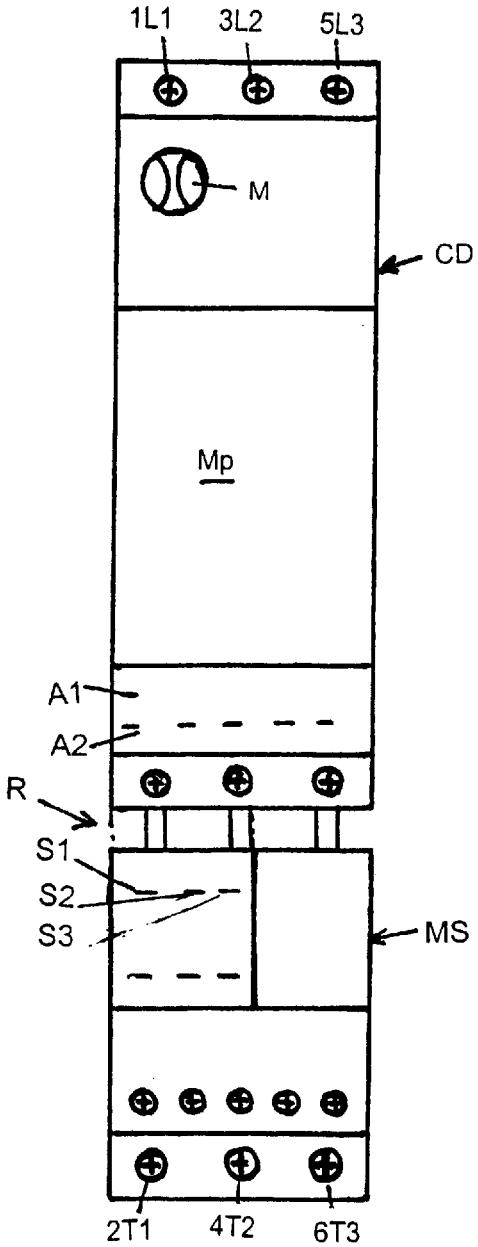
FIG. 2 is a front view diagram of the units illustrated in FIG. 1.
Figure 3:
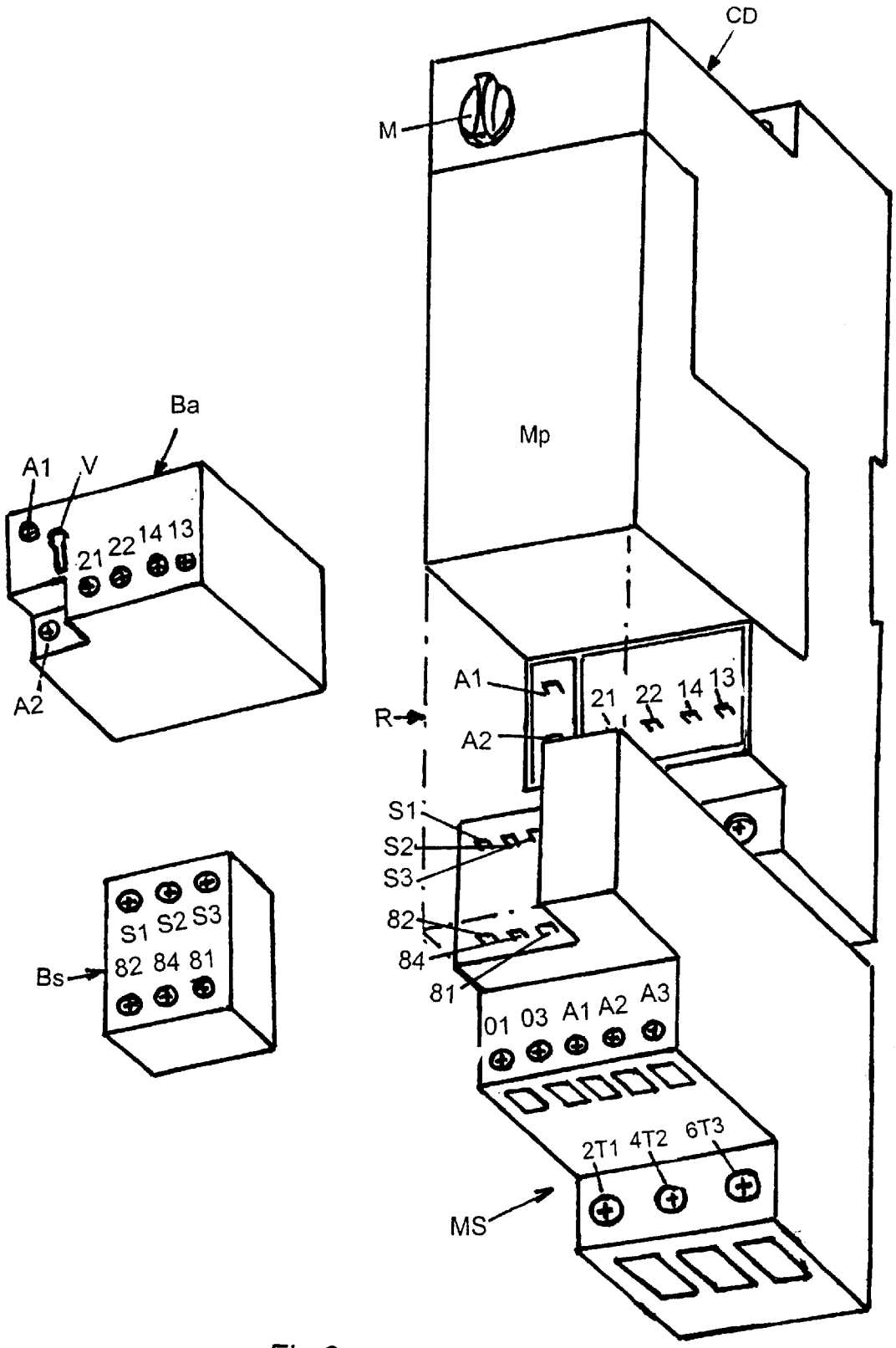
FIG. 3 is a perspective view of the units illustrated in FIGS. 1 and 2.
Figure 4:
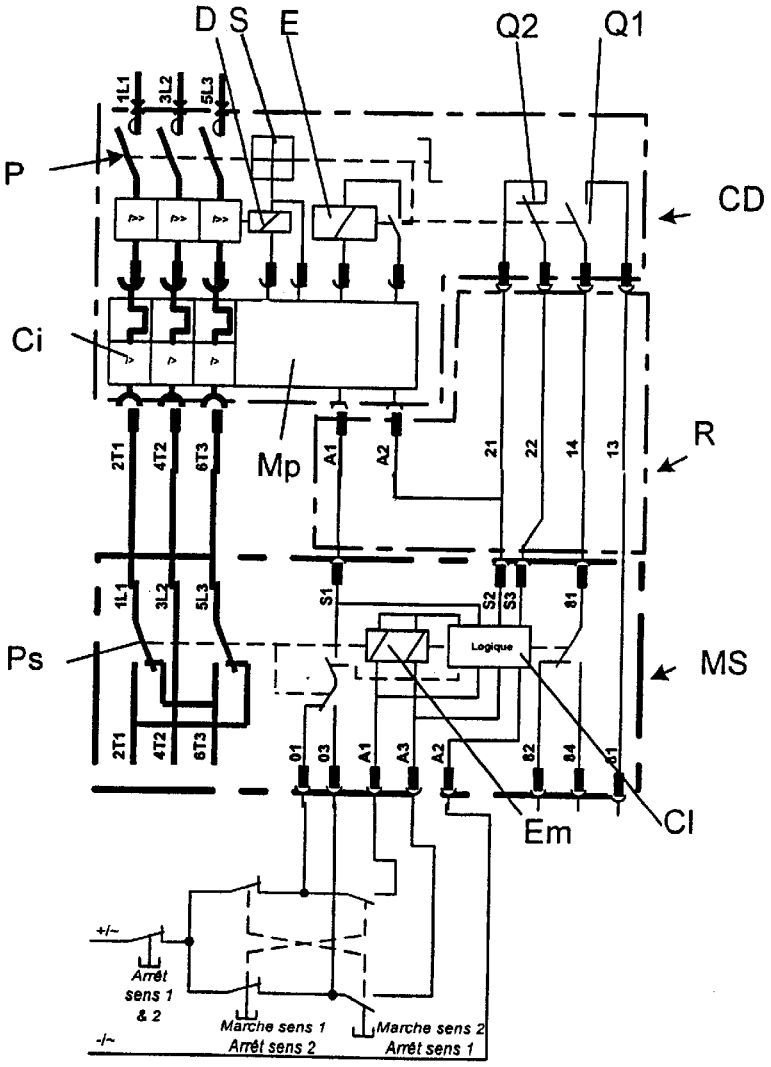
FIG. 4 is a diagram of the power and control links which connect the contactor breaker and the auxiliary module.
Figure 5:
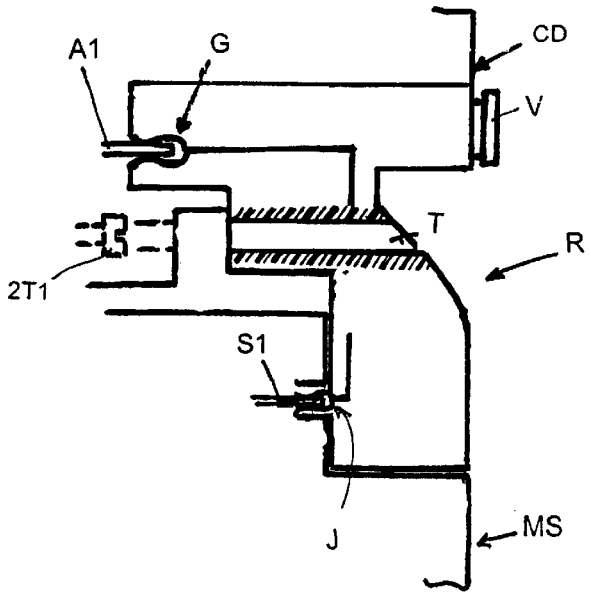
FIG. 5 is a sectional diagram of the "control" connection block which is mounted between the contactor breaker and the auxiliary module.

The set of electrical units according to the invention comprises a contactor breaker CD and an auxiliary module MS.

The contactor breaker CD is provided, in the current breaking chambers, with current breaking poles P which may break or establish current flow in the current lines. Each pole is of the double current breaking type and is formed by a bridge of mobile contacts Cm and by fixed contacts Cf connected via power conductors Cp to "source" power terminals 1L1, 3L2, 5L3 and to "load" power terminals 2T1, 4T2, 6T3. The mobile contact Cm bridge is mounted in a contact holder Pc which is attracted in the closing direction by a spring and in the opening direction by a mechanism which will be described hereafter.

The contactor breaker CD comprises a solenoid E associated with a control and tripping mechanism S associated with an electromagnetic tripping device D which acts on the poles. The solenoid E and the tripping and control mechanism S are positioned in the base B further accommodating power conductors, fixed and mobile contacts and current breaking chambers. The function of the solenoid E or of the control and tripping mechanism S is to actuate upon opening, the contact carriers of the different poles.

The base B has, at the rear, means for fixing it to a support such as a standard rail or a bearing plate and both above and below, has terminal blocks accommodating the power terminals. Below the portion containing the solenoid E and the S-D mechanism, it has a removable and interchangeable protection module Mp used for driving the solenoid E and the tripping device D according to signals delivered by the current sensors Ci which detect currents crossing the different poles.

The sensors Ci accommodated within module Mp are connected to the power conductors Cp of the different poles through resilient connectors (of the lug or clamp type) which plug into the ends of the power conductors. These sensors Ci are connected to a protective electronic circuit Ca which develops a default signal in the case of a short circuit recorded by the sensors or in the case of another electric failure. The protective electronic circuit Ca is connected at its output to the electromagnetic tripping device D of the control and tripping S mechanism and drives the power supply of the coil of the solenoid E.

A manual control button M acts on the control mechanism S in order to control the maneuvering of the poles. It is able to assume an "on" position, an "off" position and a "tripped" position.

The auxiliary module Ms performs a function of an "electrical motor control diagram" for example a function for reversing the direction of motion, a wye-delta starting function, a low speed/high speed function, etc. It has "power" input terminals 1L1, 3L2, 5L3 which are connected to "power" outputs 2T1, 4T2, 6T3 of the contactor breaker. From these power input terminals, run current lines controlled by the switching poles Ps (with permanently closed contacts) switching the current on two routes in order to perform diagrammatical functions such as: reversing the direction of motion, wye-delta starting, low speed high speed, etc. The switching poles are maneuvered by a switching solenoid Em driven by an electronic control circuit CI.

In the lower portion of the contactor breaker, outputs A1, A2, 21, 22, 14, 13 are provided, onto which a "control" terminal Ba may be connected providing conventional wire cabling or a rapid connection block R for rapidly connecting the "control" between the contact of breaker and the auxiliary module MS.

Outputs A1, A2 enable the coil of the solenoid E to be powered via the protection module Mp. The control outputs 21, 22 are connected to a first control contact Q2. The control outputs 13, 14 are connected to a second control contact Q1. These contacts Q1, Q2 are mechanically maneuvered by the S mechanism and solenoid E.

On the auxiliary module MS, outputs S1, S2, S3, 82, 84, 81 are provided onto which a "control" terminal block Bs may be connected providing conventional wiring with wires or the rapid connection block R for rapidly connecting the "control" between the contactor breaker and the auxiliary module.

The outputs S1, S2, S3 cooperate with the contactor breaker CD and the signals on these outputs are sent to an electronic logic circuit CI driving the solenoid Em for controlling the switching poles Ps. These outputs, Si, S2, S3 are connected to control outputs A1, A2 and 21 of the contactor breaker.

When the control terminal block Bs or the connection block R are removed, outputs (plugs) used for electrical connection of the terminal block Bs or of block R appear on the front face of the auxiliary module Ms.

The "control" input terminals of the auxiliary module Ms marked as 01, 03, A1, A2, A3 are for receiving commands for controlling the motor, for example delivered by control buttons. The signals applied on these input terminals are sent to the logic circuit CI or to the solenoid Em.

The connection block R is plugged, while being connected, into outputs A1, A2, 21, 22, 14, 13 of the contactor breaker and into the control outputs S1, S2, S3, 82, 84, 81 of the auxiliary module MS. It has female connectors G (of the resilient clamp type) plugging into outputs A1, A2, 21, 22, 14, 13 of the contactor breaker and female connectors J (of the resilient clamp type) plugging into outputs S1, S2, S3, 82, 84, 81 of the auxiliary module MS. It includes electrical links (wires, etc) for connecting outputs A1, A2 of the contactor breaker to outputs S1, S2 of the auxiliary module and links connecting outputs 21, 22 of the control contact Q2 to outputs S2, S3 of the auxiliary module which lead to the logic circuit CI. Electrical links connect outputs of contact Q1 to outputs 81, 82, 84.

The connection block R has holes T providing access by a tool to the power terminals 2T1, 4T2, 6T3 of the contactor breaker located behind said connection block.

Each control terminal block Bc or Bs on its front face, has a sliding locking pull rod B which in the operating position (pushed in) secures it on the contactor breaker CD or the auxiliary module MS. The terminals are of the screw type, the Faston type or the spring type. Like in the connection block, connections with the control outputs are made by the same or similar resilient connectors.

The removable connection block R equivalently has a locking pull rod.

In order to implement a motor control application, the connection block R needs simply to be plugged into the outputs A1, A2, 21, 22, 14, 13 of the contactor breaker and into the inputs S1, S2, S3, 82, 84, 81 of the auxiliary module. The auxiliary module may be mounted under the contactor breaker or on the side of the latter.

Of course, it is understood that alternatives and enhancements of details may be devised without departing from the scope of the invention and the use of equivalent means may also be contemplated.

What is claimed is:

1. A set of electrical units for controlling power units, comprising a contactor breaker (CD) with a plurality of current breaking poles actuated by a solenoid (E) and by a control and tripping mechanism (D, S) on the one hand, and by an auxiliary module (MS) connected with the power outputs of the contactor breaker and connected via control links to the latter on the other hand, characterized by the fact that it includes a control connection block (R) provided with control connectors (G) which connect to control outputs (A1, A2, 21, 22, 14, 13) of the contactor breaker onto which a control terminal block (Ba) may be connected alternatively, and with control connectors (J) connecting to control outputs (S1, S2, S3, 82, 84, 81) of the auxiliary module (MS) onto which a control terminal block (Bs) may be connected alternatively, with electrical links connecting said control connectors (G, J).

2. The set according to claim 1, characterized by the fact that the connection block (R) has connectors (G, J) and electrical links between said connectors allowing power supply outputs of the coil (A1, A2) of the solenoid of the contactor breaker to be connected to outputs (S1, S2) driving, via a logic circuit (CI), a solenoid (Em) for controlling power switching poles of the auxiliary module (MS).

3. The set according to claim 1, characterized by the fact that the connection block (R) has connectors (G, J) and electrical links between said connectors allowing the outputs (21, 22) of a first control contact (Q2) of the contactor breaker to be connected to control outputs (S2, S3) of the auxiliary module (MS) which are coupled with a logic circuit (CI) associated with a solenoid (Em) controlling the latter.

4. The set according to claim 1, characterized by the fact that the connection block (R) has connectors (G, J) and electrical links between said connectors allowing the outputs (13, 14) of a second control contact (Q2) of the contactor breaker to be connected to control outputs (82, 84, 81) of the auxiliary module (MS).

5. The set according to claim 1, characterized by the fact that the control contacts (Q1, Q2) are mechanically actuated by the tripping mechanism (S) and by the solenoid (E).

6. The set according to claim 1 , characterized by the fact that the connectors (G, J) plugging into the outputs (A1, A2, 21, 22, 14, 13, S1, S2, S3, 82, 84, 81) of the contactor breaker and of the auxiliary module (MS) are of the female type with resilient clamps.

7. The set according to claim 1, characterized by the fact that the connection block (R) has holes (T) providing access by a tool to power terminals located behind.

8. The set according to claim 1, characterized by the fact that each removable control terminal block (Ba, Bs) or connection block (R) has on its front face a lock (V) used for securing it on the contactor breaker or on the auxiliary module.

* * * * *